US010471309B2

(12) United States Patent
Kosai

(10) Patent No.: US 10,471,309 B2
(45) Date of Patent: Nov. 12, 2019

(54) AUTOMATIC GOLF BALL LIFTING DEVICE

(71) Applicant: Panurat Kosai, Bangkok (TH)

(72) Inventor: Panurat Kosai, Bangkok (TH)

( * ) Notice: Subject to any disclaimer, the term of this patent is extended or adjusted under 35 U.S.C. 154(b) by 0 days.

(21) Appl. No.: 15/530,877

(22) PCT Filed: Dec. 3, 2015

(86) PCT No.: PCT/TH2015/000087
§ 371 (c)(1),
(2) Date: Mar. 13, 2017

(87) PCT Pub. No.: WO2016/122419
PCT Pub. Date: Aug. 4, 2016

(65) Prior Publication Data

US 2017/0246514 A1 Aug. 31, 2017

(30) Foreign Application Priority Data

Jul. 3, 2015 (TH) ..... 1501003856

(51) Int. Cl.
*A63B 57/40* (2015.01)
*A63B 47/02* (2006.01)

(52) U.S. Cl.
CPC ..... *A63B 47/021* (2013.01); *A63B 57/405* (2015.10); *A63B 2220/833* (2013.01)

(58) Field of Classification Search
CPC ..... A63B 57/405
USPC ..... 473/175, 176, 178
See application file for complete search history.

(56) References Cited

U.S. PATENT DOCUMENTS

| | | | | | |
|---|---|---|---|---|---|
| 1,658,145 | A | | 2/1928 | Uyei | |
| 3,467,378 | A | * | 9/1969 | English | A63B 57/405 473/178 |
| 3,897,059 | A | * | 7/1975 | McCulloch | A63B 57/405 473/178 |
| 5,018,730 | A | * | 5/1991 | Iliuta | A63B 57/405 473/175 |
| 5,393,053 | A | | 2/1995 | Wiese | |
| 5,480,142 | A | * | 1/1996 | Ackerman | A63B 57/40 473/177 |
| 5,890,967 | A | | 4/1999 | Allen | |
| 5,964,667 | A | * | 10/1999 | Brookman | A63B 57/357 473/175 |
| 8,025,584 | B2 | * | 9/2011 | Foley | A63B 57/405 473/178 |
| 2014/0295981 | A1 | | 10/2014 | King | |

(Continued)

FOREIGN PATENT DOCUMENTS

| | | | |
|---|---|---|---|
| KR | 10-0590908 | B1 | 6/2006 |
| WO | WO 2007/011159 | A1 | 1/2007 |

*Primary Examiner* — Mark S Graham
(74) *Attorney, Agent, or Firm* — Kim IP Law Group PLLC

(57) ABSTRACT

An automatic golf ball lifting device is inside the cylindrical cup; when switched-on can remotely, accurately and instinctively know the presence of a "on a hole" golf ball, hence a golf ball on its receiving plate situated approximately 4 inches ground depth, is mechanically raised on the ground level, lifting the golf ball continuously, for faster and easier access; wherein removal of the golf ball prompts the system to automatically lower the top receiving plate to its original position, in preparation for the next ball to be sensed and elevated.

12 Claims, 6 Drawing Sheets

(56) References Cited

U.S. PATENT DOCUMENTS

2015/0352418 A1* 12/2015 Skurow ..... A63B 57/0056
473/178

* cited by examiner

AUTOMATIC GOLF BALL LIFTING DEVICE

FIELD OF INVENTION

The present invention relates generally to a golf equipment specialty an automatic device for weighting and lifting a golf ball up from the bottom hole to the green level.

BACKGROUND OF THE INVENTION playing golf involves a tedious picking up of a golf ball from the bottom of a golf hole. This repetitive action may be contributory to back pain and muscle inflammation. To support golf players' health and convenience while playing, it is important and advantageous if any automatic device can be made available to golfers. Such as the hand operating caddy club device which was invented by Nao Uyel in 1928. His golf ball picker (U.S. Pat. No. 1,658,145) has been instrumental to assist players in the green. And like such device, which has helped many golfers at that time, new designs brought about by innovations and inventions with the use of current technology such as an automatic golf ball lifting device might be essential for convenience, health and additional fun for golfers nowadays.

For this reason, it would be good to produce for golf courses or golf lovers even for entertaining event regarding this device is users-friendly.

SUMMARY OF THE INVENTION

This invention is an automatic golf ball lifting device that has 2 main components. The first consists of a cylindrical tube, designed with small drainage holes at the bottom, with a flagstick tube at the center. The second resides in the first component and is an assembly of 3 circular parts namely; a base round plate, a body cylinder and a top round plate. The device will always have its initial starting position, and will raise any golf ball that nests inside it. It will mathematically read the weight of the fallen golf ball, prompting the golf ball lifter to carry the ball to the green surface permanently until the ball is removed, now prompting the lifter to lower the plate to the first position. This cycle is programmed continuously.

DETAILED DESCRIPTION OF THE PREFERRED EMBODIMENTS

Figure 1:
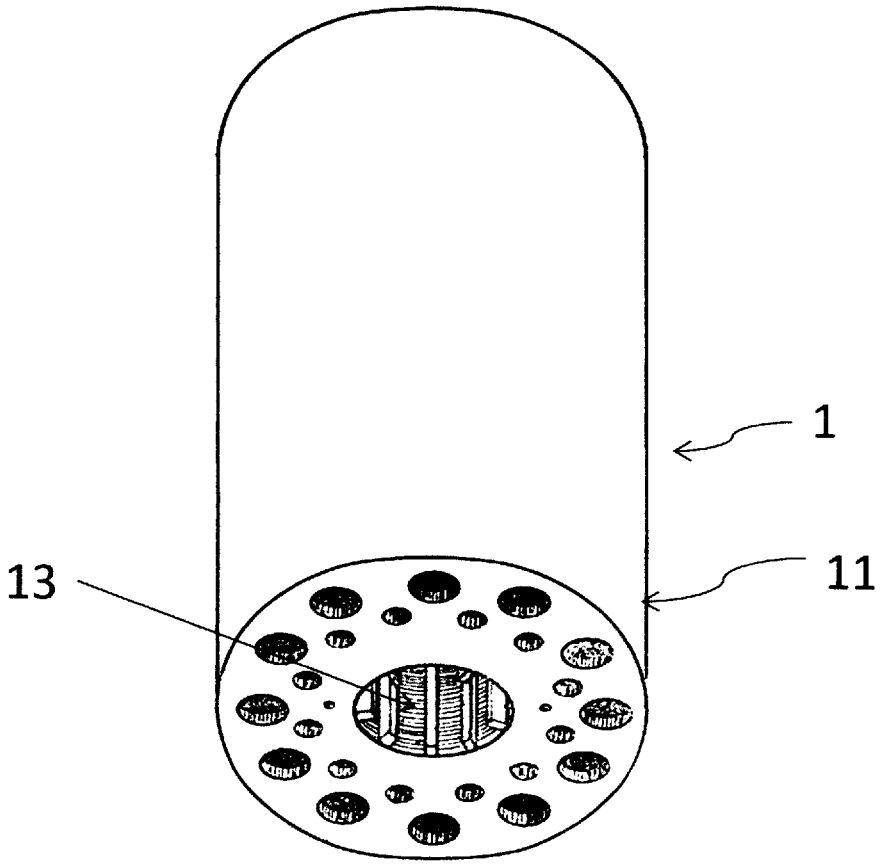
FIG. 1 is a perspective view from the bottom of an automatic golf ball lifting device to understand the external concept.

FIG. 1 To show the overall image of this invention; an automatic golf ball lifting device 1 made of durable materials. A long tube 11 as the first component has a dimension of a standard golf cup in accordance to the R&A and the United States Golf Association.

Figure 2:
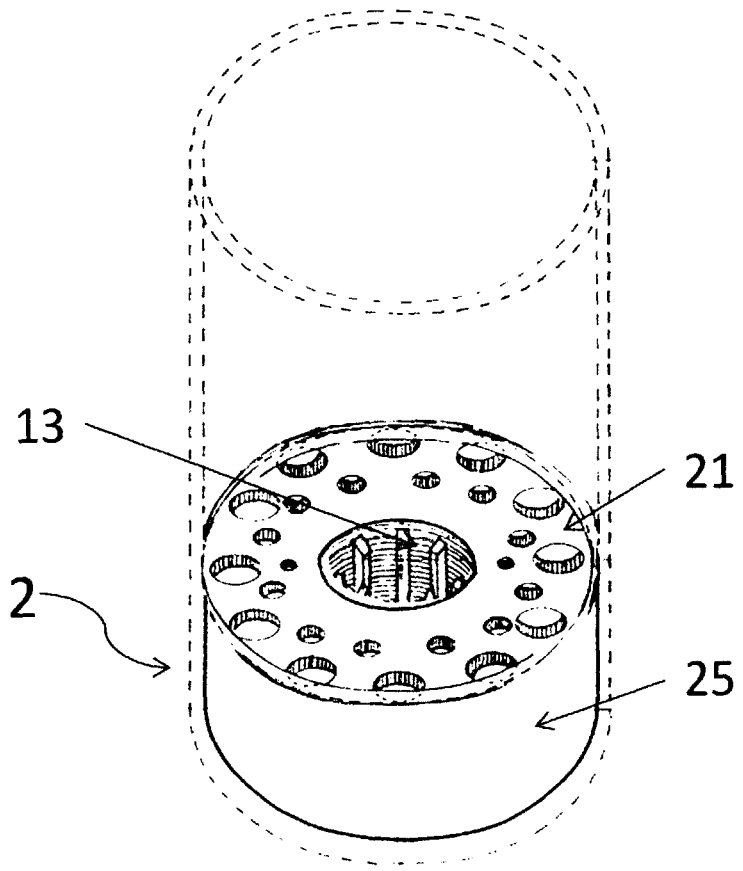
FIG. 2 is a perspective view of the second part cylinder in accordance with an assembly and a ready to use, the first position mode.
Figure 3:
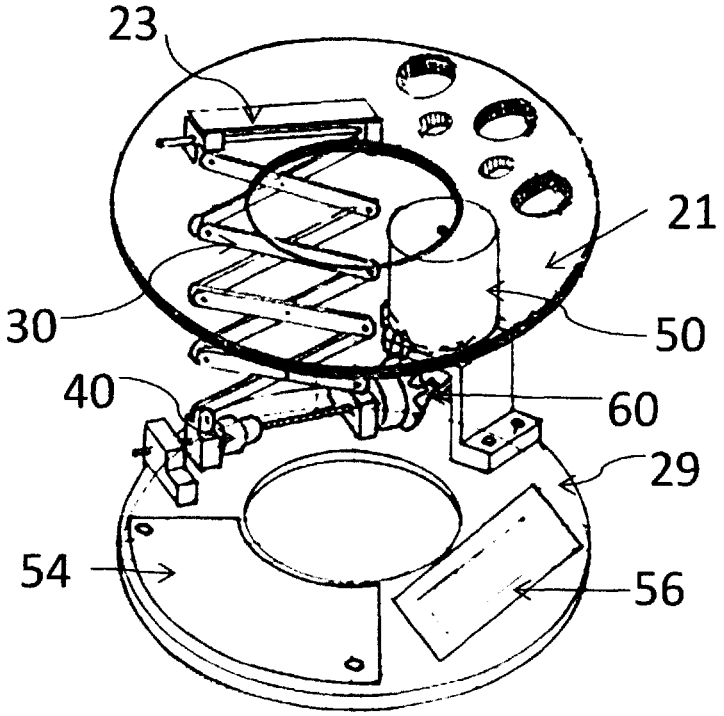
FIG. 3 is a perspective view of the golf ball lifter system installation between the top round plate and the base round plate that useful for understanding the inventive concept revealed herein.

FIG. 2 To complete the device, the second element described as a cylindrical cup-shape and a combination of 3 circular parts namely; a top round plate 21, a body cylinder 25, and a base round plate 29, as shown in FIG. 3: a top round plate 21 including that circular hole at the center. The top round plate 21 functions to receive a golf ball with 2 small holes to screw the housing of a load cell which is installed beneath the top plate as shown in FIG. 3; the top most has nesting small holes inspired from a golf tee head, essential for stability and beneficial brand communication; a body cylinder 25 has an open top and bottom ends including 3 small holes.

FIG. 3 To understand and present the mechanical system, objects where installed on a base round plate 29 for the invented sequential and operational movement: having 2 printed circuit boards, one PCB is positioned on a battery bar to communicate with a remote control that functions to switch on and off the device before start working, the device is actuated by switching on the device which is located at the body cylinder. A printed circuit board 54 functions to operate all components by command start; the battery bar 56 functions to supply electrical power to the encoding motor 50, while supplying power to the motor, it activates the bronze bevel gear 60 to self rotate a ball screw 40 on both clockwise and anticlockwise actions, allowing the golf ball lifter 30 to change its height to and from the preset level; on top of the lifter is the load cell and its housing 23 that is attached and screwed to the top plate 21.

Figure 4:
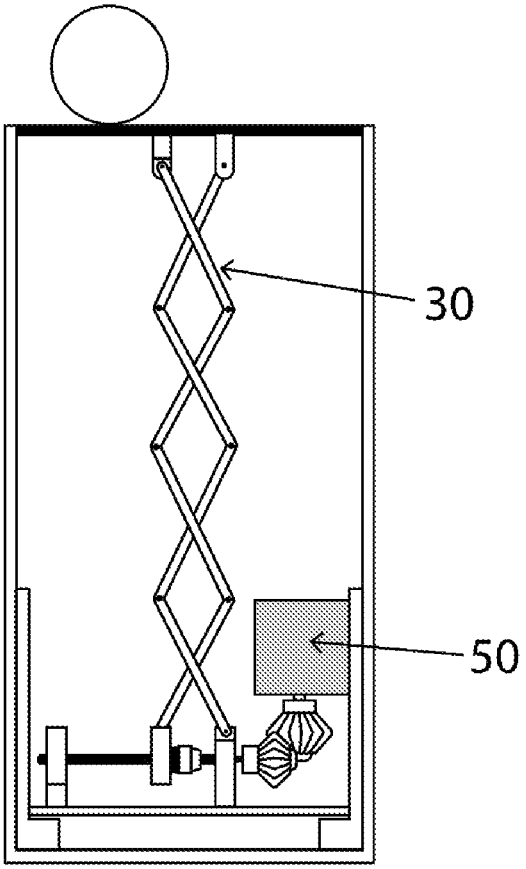
FIG. 4 is a perspective view of the golf ball lifter or 4 mini scissors lifting system while it is carrying the top plate with a golf ball up to the green level, "on a hole" position.

FIG. 4 For a side view presentation of the golf ball lifter system's operation when a golf ball is detected 1, the lifter 30 carries the top plate 21 with a golf ball to the green level showing brand identity, letters, numbers, colors or symbols. This way is similar to the system of the elevator or a lifting device consisting of a platform or cage that is raised and lowered mechanically in a vertical shaft in order to move people or objects from one floor to another in a building as a preset height and weight's capacity that should be fit in the specific area but different by a lifting method regarding the elevator having a hoist and this invention having a mini scissor lifter and a load cell as a major of construction.

Figure 5:
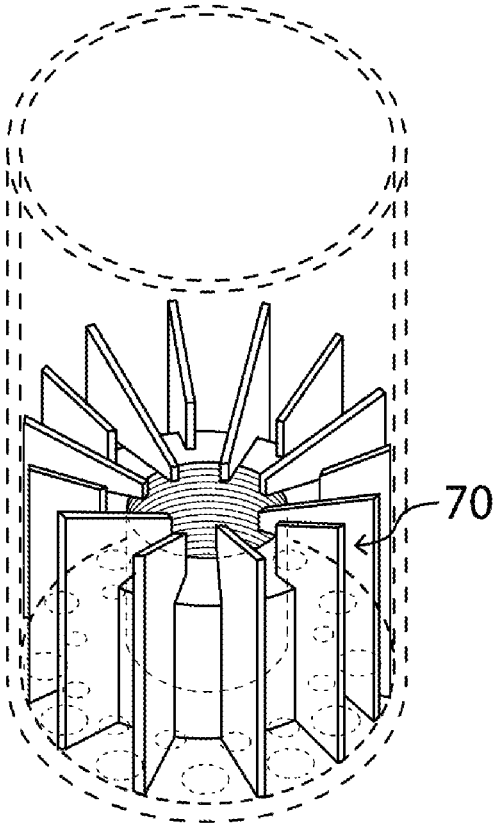
FIG. 5 is a perspective view of a detachable golf ball receiver, to be placed and locked up with the bottom end of a long tube, in case of manual purpose needed.

FIG. 5 In case the device needs to be detached for maintenance, players or operator can replace the detachable golf ball receiver 70 manually by unlocked the pins located at the bottom, the usage is simply like changing a cup of blender. It is also designed to have a flagstick hole at center.

Figure 6:
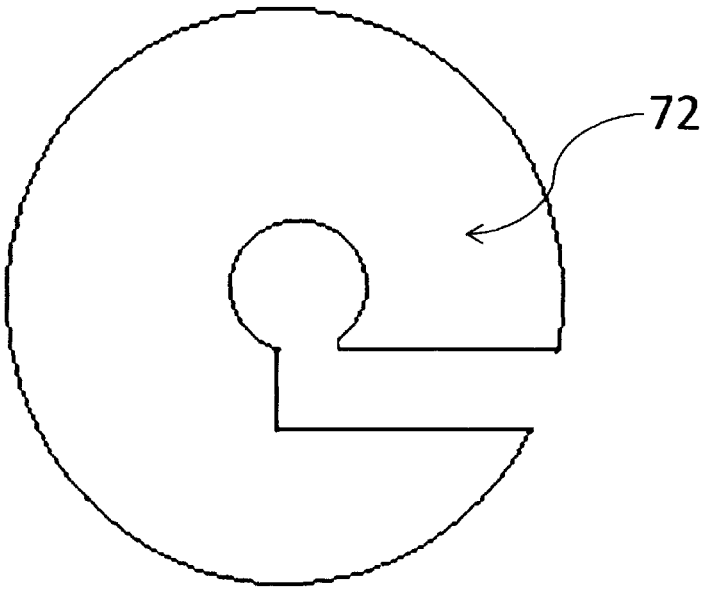
FIG. 6 is a top view of a covering plate for preventing dust or small pieces of stone that may fall down into the device.

FIG. 6 is a thin plate made of any durable material for covering the device; positioned on top of the body cylinder to prevent dust, small stone or any particles from falling directly to the lifting mechanism and better to protect its surface by using a water resistant coating that water and many other liquids are easily repelled.

In addition, a bellow cover is used to cover the lifter 30 and the ball screw 40 to protect the components from dust or any particles which might fall down the mechanism.

Thus, to protect the components from dust or any particles, which might fall down of the mechanism, it is possible that either a rigid or elastic type of cover is used.

It will be understood that modifications may be made within the scope of this invention without departing from the spirit thereof. It is accordingly intended that all matter contained in the above descriptions be interpreted as illustrative rather than in a limiting sense.

It is also to be understood that the following claims are intended to cover all the generic and specific features of the invention as described herein, and all statements of the scope of the invention which, as a matter of language, might be said to fall thereof.

I claim:

1. An automatic golf ball lifting device for lifting a golf ball within a golf hole comprising:

a top plate having a diameter sufficient to substantially span a width of a golf hole diameter;

a lift for moving the top plate between a first position and a second position raised relative to the first position for positioning the top plate at a level of a green surrounding the golf hole;

a motor operatively connected to the lift for moving the lift between the first position and the second position;

a load cell in communication with the top plate and motor;

a printed circuit board configured to:

receive load signals from the load cell indicative of a golf ball supported or not supported on the top plate, and provide actuation signals to operate the motor to move the lift from the first position to the second position when a golf ball is supported on the top plate, and move the lift from the second position to the first position when a golf ball is not supported on the top plate; and a battery for providing power to the printed circuit board, the motor and the load cell.

2. The automatic golf ball lifting device of claim 1, further comprising a screw driven by the motor and drivingly connected to the lift.

3. The automatic golf ball lifting device of claim 2, further comprising a bevel gear carried by an end of the screw, wherein the motor drives the bevel gear to turn the screw in clockwise and anticlockwise directions to operate the lift.

4. The automatic golf ball lifting device of claim 1, wherein the lift is a scissor lift.

5. The automatic golf ball lifting device of claim 1, further comprising a bellows cover covering the lift.

6. The automatic golf ball lifting device of claim 1, wherein the top plate includes a flag stick hole.

7. The automatic golf ball lifting device of claim 6, wherein the top plate includes a plurality of holes surrounding the flag stick hole for receiving and holding a golf ball in place as the lift moves from the first position to the second position.

8. The automatic golf ball lifting device of claim 1, further comprising a remote control operatively in communication with the printed circuit board to actuate the motor.

9. The automatic golf ball lifting device of claim 1, further comprising a cover covering an inner cylinder disposed at a center of the device.

10. The automatic golf ball lifting device of claim 6, further comprising a first plurality of holes of a first size circumscribing the flag stick hole and a second plurality of holes of a second size circumscribing the flag stick hole.

11. The automatic golf ball lifting device of claim 10, wherein the second plurality of holes define a circumference having a diameter smaller than a circumference defined by the first plurality of holes.

12. The automatic golf ball lifting device of claim 1, further comprising a detachable golf ball receptacle including a plurality of fins for holding a golf flag.

* * * * *